US006846365B2

(12) United States Patent
Madanshetty

(10) Patent No.: US 6,846,365 B2
(45) Date of Patent: Jan. 25, 2005

(54) METHOD AND APPARATUS FOR ACOUSTIC SUPPRESSION OF CAVITATION

(76) Inventor: Sameer I. Madanshetty, 6923 Redbud Dr., Manhattan, KS (US) 66503

( * ) Notice: Subject to any disclaimer, the term of this patent is extended or adjusted under 35 U.S.C. 154(b) by 116 days.

(21) Appl. No.: 10/157,241

(22) Filed: May 30, 2002

(65) Prior Publication Data

US 2002/0179111 A1 Dec. 5, 2002

Related U.S. Application Data

(60) Provisional application No. 60/293,919, filed on May 30, 2001.

(51) Int. Cl.[7] ..... B08B 3/12

(52) U.S. Cl. ..... 134/1; 367/131; 137/13; 137/14; 137/828

(58) Field of Search ..... 134/1; 367/131; 137/13, 14, 828

(56) References Cited

U.S. PATENT DOCUMENTS 5,594,165 A * 1/1997 Madanshetty ..... 73/61.75
5,681,396 A * 10/1997 Madanshetty ..... 134/1.3
5,694,936 A * 12/1997 Fujimoto et al. ..... 600/439
5,717,657 A * 2/1998 Ruffa ..... 367/131
5,884,650 A * 3/1999 Ruffa ..... 137/13
6,395,096 B1 * 5/2002 Madanshetty ..... 134/1

FOREIGN PATENT DOCUMENTS

JP 2000287988 A * 10/2000

* cited by examiner

*Primary Examiner*—M. Kornakov
(74) *Attorney, Agent, or Firm*—McIntyre Harbin & King

(57) ABSTRACT

The invention provides a method and apparatus for suppressing hydrodynamic cavitation through the use of high frequency (>500 kHz) and high amplitude (>1 atmospheres) acoustic energy. The method includes biasing a transducer driving signal to generate an acoustic field having a positive pressure halves. The resulting acoustic field is imposed on a region where cavitation is to be preempted. A cavitation preempting acoustic field in the liquid is similar in effect as using a hyperbaric confinement for imposing hydrostatic pressure, a known method for suppressing cavitation. In this regime, suppression of cavitation will be due to imposing a dominant high amplitude, high-frequency pressure field to ensure that the gaps between the compressive pulses are shorter than $10^{-7}$ to $10^{-6}$ seconds, which is less than that typically necessary to cause cavitation.

1 Claim, 3 Drawing Sheets

METHOD AND APPARATUS FOR ACOUSTIC SUPPRESSION OF CAVITATION

CROSS-REFERENCE TO RELATED APPLICATION AND PATENTS

This invention claims the benefit of U.S. Provisional Application Ser. No. 60/293,919, filed May 30, 2001, in the name of the inventor hereof.

This invention also relates to U.S. application Ser. No. 09/488,574 entitled "Single Transducer ACIM Method and Apparatus" filed Jan. 21, 1999 (now U.S. Pat. No. 6,395,096), in the name of the same inventor hereof, which is incorporated herein by reference.

BACKGROUND

The invention concerns acoustic cavitation, but more specifically, the invention concerns a method of and an apparatus for suppressing cavitation on a surface of an element in a mechanical system, such as working surfaces in hydraulic equipment.

Cavitation concentrates energy; its occurrence may deleteriously erode surfaces of mechanical elements, even elements made of tungsten or steel. Problematic cavitation is encountered in land, sea, and air vehicles or equipment, whose designs are typically made to avoid cavitation events. At least one hundred years have passed since initial studies of propeller erosion, and since then, much knowledge has been gained in the industry about bubble dynamics and the energetics of cavitation. But even today suppressing cavitation has not successfully been achieved; it still remains an engineering priority. Developing cavitation-proof structural designs and materials often leads to extremely conservative designs, invariably underrealizing the full performance potential of many systems. Cavitation also limits the amount of power that may be mechanically coupled to fluids in hydraulic systems. Fluid includes liquids or other matter in which cavitation may be invoked.

A known method to reduce cavitation includes statically over-pressuring a region over a surface where cavitation pre-emption is sought. As known in the art, subjecting an imperfectly wetted crevice-like region located on surfaces or liquid-borne particles to reduce pressure or tensile environments may nucleate cavitation. Imposing a sufficiently high static pressure on the liquid drives a crevice's liquid meniscus to its root. Eventually, the liquid may adequately wet the crevice-like feature and thus preempt cavitation. It is extremely difficult, however, to create cavitation in fully wetted regions associated with liquids because homogeneous nucleation thresholds generally exceed several hundred atmospheres of peak negative pressure. If, however, overpressuring does not fully wet all cavitation nuclei, should cavitation occur, the violence of cavitation implosion in the statically overpressured environment would be more energetic thereby causing greater surface damage, thus defeating the purpose of cavitation-proof design in the first place.

The above-mentioned hyperbaric confinement technique of cavitation suppression requires containment of the region if it is to be made cavitation-proof. Such physical containment constitutes a primary limitation to cavitation suppression on exterior surfaces of a mechanical element or structure, like a sonar dome or propeller of a sea vessel.

Thus, it is highly desirable to provide a method of and system for cavitation suppression operable in either contained or open environments, and specifically, to provide a method and a system that does not require any hyperbaric confinement.

The confinement limitation may be circumvented by subjecting the targeted region to become a "cavitation proof surface" (CPS) with high frequency ultrasonic waves. Inventor A. Ruffa of U.S. Pat. Nos. 5,996,630; 5,884,650; and 5,717,657 has suggested using a high frequency acoustic energy field, of say one MHz, to flow over the intended CPS. As is known in the art and as Ruffa indicates that such insonification will prevent cavitation occurrences because cavitation thresholds are high and the time duration available for bubble processes is small at high frequencies. However, it has found that one can indeed bring about cavitation quite readily at high frequencies upon invoking an effect known as "acoustic coaxing" to facilitate cavitation nucleation. Implementing Ruffa's suggestion does not appear operable to suppress cavitation, but in fact is believed to enhance cavitation.

SUMMARY

According to a first aspect of the present invention, a method of suppressing cavitation in or about a region of a surface that is subjected to cavitation-producing energy comprises providing a transducer and exciting the transducer to produce a biased acoustic field comprising a series of pressure pulses in the region that exceed peak negative tensile force of cavitation-producing energy.

According to another aspect of the invention, there is provided an apparatus that suppresses cavitation in or about a region of an element subjected to cavitation events comprising a transducer and a source of power that excites the transducer to produce a biased acoustic field in and/or about the region to be protected.

Other aspects of the invention will become apparent upon review of the following description taken in connection with the accompanying drawings. The invention, though, is pointed out with particularity by the appended claims.

DESCRIPTION OF ILLUSTRATIVE EMBODIMENTS

According to an aspect of the present invention, cavitation prevention is achieved by suppressing the rarefaction or tensile phase of insonifying waves, i.e., by ensuring that the acoustic waves only contain compressive peaks in rapid succession. Ordinarily, AC power amplifiers that drive the transducer amplify the driving voltage symmetrically about a ground reference level even when the inputs contain a DC bias. However, by introducing an appropriate biasing circuit between the output of the power amplifiers and the input of the acoustic wave producer, e.g., a transducer, it may be possible to produce an acoustic field that yields only positive pressure pulses or positive wave halves.

Driving a transducer so that high frequency, high amplitude sequences of positive pressure pulses present over the CPS of a targeted region effectively provides a "containerless" hyperbaric environment and precludes cavitation events. Various methods and apparatuses may be employed to provide such bias. For example, one can provide a diode circuit for rectification or voltage divider circuits with mixers or other suitable circuit devices to drive the acoustic transducer at one bias level—for instance, in either only positive or only negative bias level. The transducer performance is not expected to deteriorate under such biased drive because the driving does not have a tendency to cause depoling. The presence of adequately intense, rapidly fluctuating, "positive pressure" will not engender cavitation nucleation—lacking acoustic pressure pulses in a liquid region—will not engender any cavitation nucleation and hence preclude the occurrence of cavitation.

Figure 1:
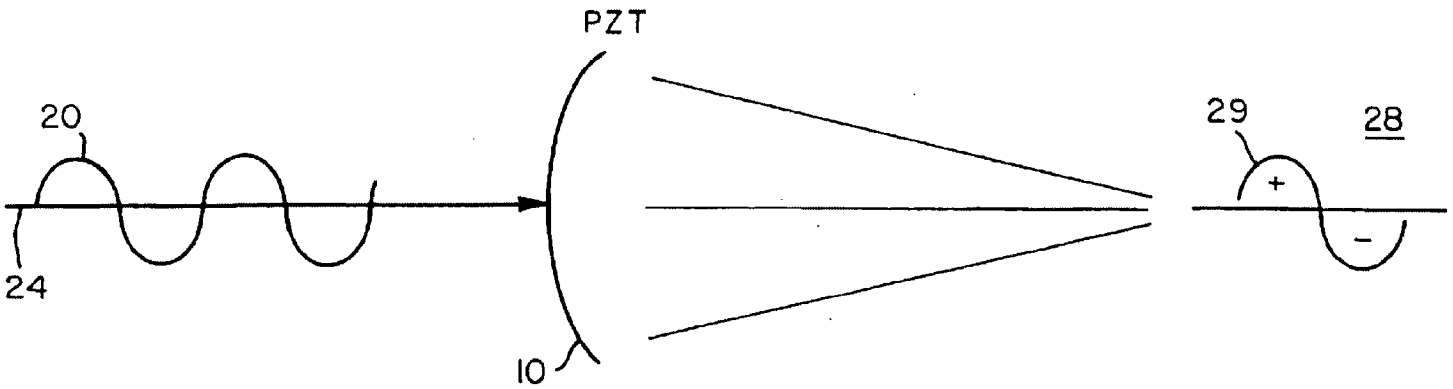
FIG. 1 PRIOR ART
FIG. 1 shows biased excitation of a transducer in accordance with the prior art.
Figure 2:
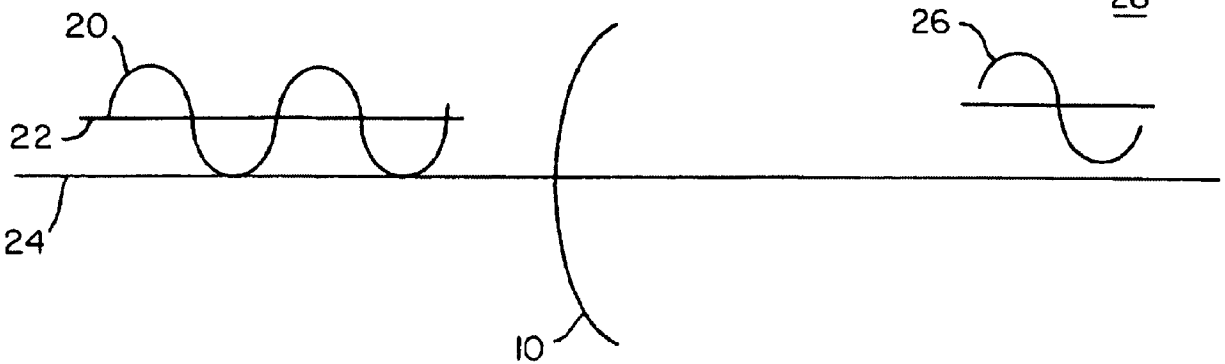
FIG. 2 shows a preferred method and apparatus of producing biased acoustic fields for cavitation suppression in accordance with an aspect of the present invention.

In one implementation of the invention depicted in FIG. 2, a transducer 10 (only its surface is shown) is driven by a source that produces a driving signal 20. An exemplary transducer is disclosed in commonly-owned, incorporated U.S. Pat. No. 6,395,096. As seen, the driving signal 20 is biased at a positive level 22 so that positive and negative excursions of the driving signal 20 remain above the ground level 24. As such, transducer 10 produces acoustic waves 26 that also reside in the positive pressure realm of the fluid matter 28, which carries the energy to the CPS area to be protected. If the driving signal is not biased, as depicted in FIG. 1, positive and negative excursions oscillate above and below the ground level 24, whereupon acoustic energy pulse 29 engenders cavitation within the fluid 28 around the CPS region In actual implementation, a cavitation suppression transducer 10 may be located at a region behind the liquid-hosting cavitation, e.g., inside the propeller or sonar dome, or it may be positioned directly within the liquid at a location that subjects acoustic suppression energy directly upon the CPS area to be protected.

Once a cavitation bubble has formed it cannot be locally closed unto itself. In this regard, cavitation in liquids is like fracture in solids. The fracture in the liquid, however, assumes a spherical shape of a bubble primarily because of surface tension, and a lack of resistance on the part of the liquids for shape change. Once a bubble is formed, the only way to render the liquid at that location cavitation free is to remove the bubble by some means, hydrodynamic or kinetic buoyancy, mechanical, thermal or fluid flow.

Cavitation suppression proposed by the present invention involves prevention of bubble nucleation, and for this there should not be any reduced pressure environment, or tensile (negative pressure) pressure environment within the region of control, the CPS area (regardless of the flow conditions).

Figure 3:
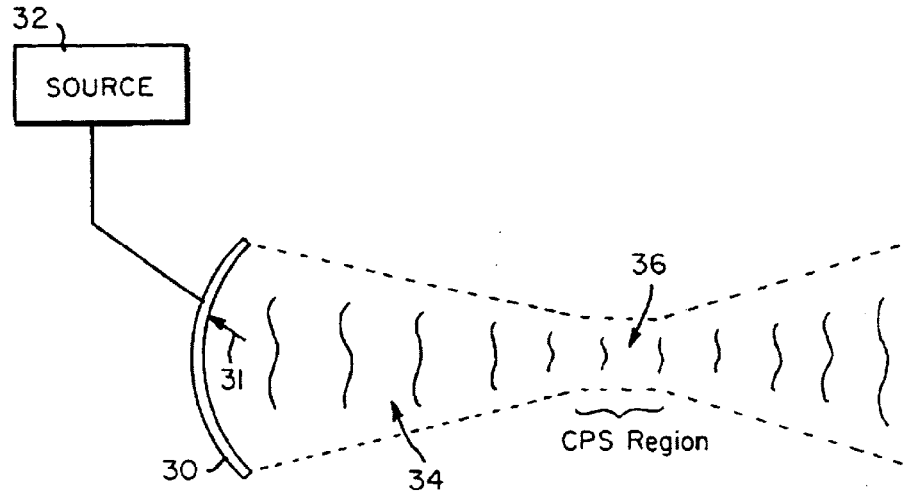
FIG. 3 illustrates a transducer producing a series of pressure pulses in a surrounding medium.

Referring to FIG. 3, consider, for example, an acoustic transducer 30 to be a piston that vibrates under electrical excitation applied by source 32 in order to launch acoustic waves or pressure pulses 34 into adjoining liquid at a frequency imposed by the oscillation. If the piston's diameter is several times the acoustic wavelength, then the sound beam generated by piston 30 is essentially a one-dimensional sound field where the beam's cross-section is finite and collimated. The beam traverses the liquid environment in an unbounded manner. Now, if any suitable cavitation nuclei exist in the path of the beam, cavitation can be initiated if the sound beam has tensile peaks stronger than the cavitation threshold. If it is desired to render a given region of space 36 in the liquid free of cavitation, it is imperative that no cavitation be initiated within the CPS region. As stated earlier, if the region has a sufficiently strong compressive pressure environment, or if it is under a suitably high hydrostatic pressure confinement, cavitation will not nucleate in this region. Subsequently, it is provided how transducer 30 can be made to generate effective compressive fields over the CPS.

A closer study of the vibrating piston as the source of sound in a liquid tube reveals that as long as the piston moves towards the liquid in the direction of wave propagation of the launched wave, it will generate a compressive phase of the wave. The instant the piston starts to retract, moving away from the liquid in the opposite direction to the launched wave, it begins generating expansion fans that lead to the tensile phase of the wave. To avoid expansion fans, the liquid should not encounter a receding or withdrawing piston. One way to achieve this is to impart a steady axial velocity to the piston as it vibrates, that is, to bodily move the piston into the liquid in the direction of the propagation of a launched wave at a speed so that the resultant piston velocity is never negative. Due to finite translations of most mechanical systems, however, a single piston cannot be continuously and forever moved "into" the liquid at such a steady state velocity.

Figure 4:
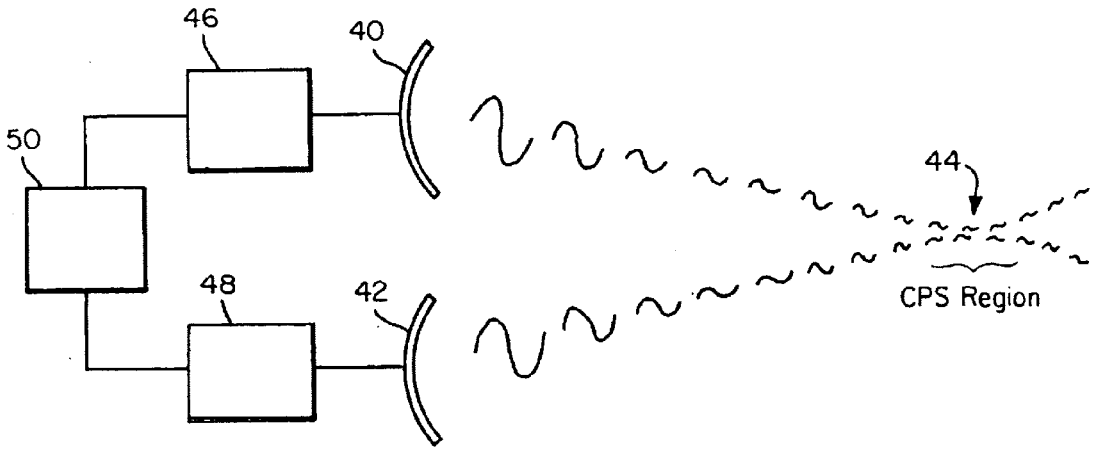
FIG. 4 depicts alternately activated transducers to produce compressive pulses according to one embodiment of the present invention.

An arrangement depicted in FIG. 4, where two pistons 40 and 42 aimed at CPS region 44 are moved alternately—one being vibrating and traversing while the other being retracted and switched off, and when the first finishes its traverse it is switched off and slowly retracted while the other is switched on and traversed—might be used, but a more direct implementation would be useful. As discussed earlier, the first transducer 40 is excited by translator 46 and the second transducer 42 is excited by translator 48. A sequencer 50 effects timed, synchronized excitation of the translators 46, 48 to alternately move the pistons 40, 42 in a manner to achieve cavitation suppression. Both transducers need not be simultaneously vibrated, and more critically, a transducer should not be vibrated while retracting.

To avoid retracting the piston from the liquid, the head of the piston should not retreat relative to the local liquid directly in front of it. One way to achieve this includes arranging for the liquid to flow onto the face of the vibrating piston in a direction 31 at a sufficient velocity, e.g., a mean velocity greater than or equal to the pressure amplitude divided by the acoustic impedance, the product of the density and the speed of sound in the liquid. This is illustrated in FIG. 3 by ensuring adequately fast flow direct on the face of the transducer in the direction 31.

Figure 5:
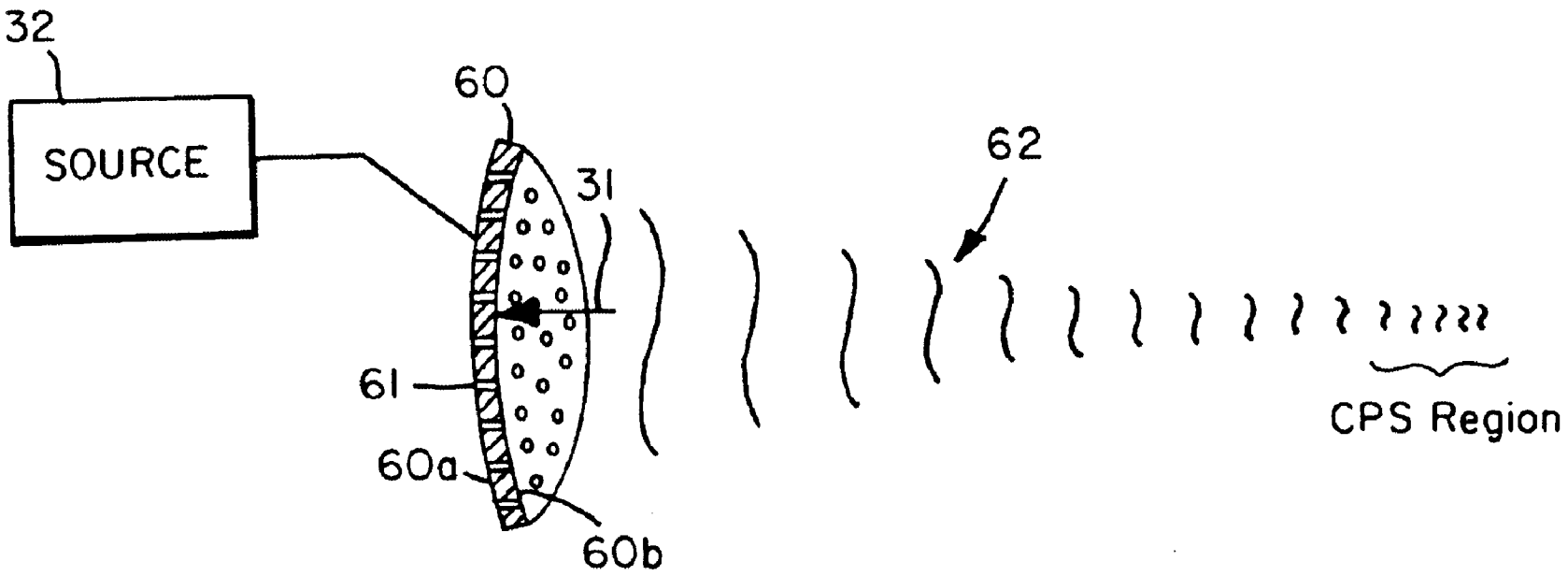
FIG. 5 depicts another embodiment of the invention utilizing a perforated or plate transducer having a series of orifices to produce compressive pulses in a surrounding medium.

In another embodiment illustrated in FIG. 5, where a piston or transducer 60 is perforated like a sieve. On side 60*a*, liquid is sucked out by a vacuum, and on side 60*b*, pressure pulses 62 are produced and emitted into the surrounding liquid. Either liquid can be sucked onto the piston through a series of orifices 61 disposed therein, or the liquid can be made to impinge on the face of transducer 60. The size and density of the orifices 61 may be chosen to obtain appropriate flow without compromising the structural integrity of the transducer and adjusted to match the desired dynamics of the acoustic system. As an example, transducer 60 having a two-inch diameter with ten to twenty orifices of about 1.0 mm in diameter may be used for this purpose. One may also use a perforate plate with small transducer arrayed thereon. In either case, the piston 60 will not retract relative to the liquid ahead of it during any phase of its vibratory motion. Consequently, only unipolar (non-tensile-going) waves will be set-up along the propagation direction even if the electrical excitation is bipolar. When the CPS region encounters such compressive pulses of sufficient intensity and rapidity, effectively the CPS area becomes acoustically biased and experiences only a compressive environment similar to the hydrostatic over-pressure environment, and thus, cavitation nucleation is prevented according to as aspect of the present invention. The CPS area may also comprise a standing body of liquid or a region of hydrodynamic flow. In either case, occurrence of cavitation is precluded if compressive pulses sufficient strength and frequency reside over the region.

One may use a flat or planar transducer if moderate compressive pulse are desired, or a focused transducers if intense compressive are needed. The above arrangement can be obviated if the liquids were incapable of supporting tension. In gaseous environments, one cannot launch a tensile wave because gases cannot support tension. If a liquid region excluding a CPS region is seeded with gas bubbles, then that two-phase region will not support tension significantly. Therefore if such a region is interposed between the piston-transducer and the CPS region, only the compressive pulses will pass through the latter. The bubbly region effectively acts as a filter or a half-wave rectifier.

The embodiments disclosed herein are exemplary and, as such, are not intended to limit the scope of the invention. Based of these teachings, modifications and adaptations are envisioned that fall within the scope of the invention defined by the appended claims.

What is claimed to be secured by United States Letters Patent is:

1. A method of suppressing cavitation in or about a region of a surface immersed in a liquid medium and subjected to cavitation-producing energy, said method comprising providing a transducer in fluid communication with said liquid and exciting the transducer to produce a biased acoustic field in a direction of wave propagation, said acoustic field in said region comprising a series of pressure pulses that exceed peak negative tensile force of cavitation-producing energy wherein the proving step includes moving of said liquid medium through passages of said transducer in a direction of propagation of said pressure pulses.

* * * * *